United States Patent [19]

Hoftman

[11] 3,990,596

[45] Nov. 9, 1976

[54] HANDLE ATTACHMENT FOR A BABY BOTTLE

[76] Inventor: Moshe Hoftman, 3326 Sawtelle Blvd., Los Angeles, Calif. 90066

[22] Filed: July 7, 1975

[21] Appl. No.: 593,475

[52] U.S. Cl. ..... 215/11 R; 215/100 A

[51] Int. Cl.[2] ..... A61J 9/06

[58] Field of Search ..... 215/11 R, 11 C, 100 A; 220/94 R, 90.2; 294/27 H, 27 R, 31.2; 222/465, 466, 467

[56] References Cited

UNITED STATES PATENTS

| | | | |
|---|---|---|---|
| 250,276 | 11/1881 | Morris | 215/100 A UX |
| 871,622 | 11/1907 | Pettee | 215/11 C UX |
| 1,617,213 | 2/1927 | LaPaugh | 215/11 R |
| 1,637,719 | 8/1927 | Whitlock | 215/11 C |
| 2,610,081 | 9/1952 | Bushman | 215/100 A X |
| 2,886,366 | 5/1959 | White | 215/100 A X |

FOREIGN PATENTS OR APPLICATIONS

| | | | |
|---|---|---|---|
| 638,832 | 2/1928 | France | 215/100 A |

*Primary Examiner*—Donald F. Norton
*Attorney, Agent, or Firm*—Jack C. Munro

[57] ABSTRACT

A handle to facilitate holding a baby bottle into a drinking position by an infant having a single handle or a double handle extending in an arc in a direction from the top of the baby bottle adjacent the side wall of the bottle at the bottom of the baby bottle, the handle may be formed integral with the cap portion of the baby bottle or may be connected to a ring which is located around the baby bottle in direct contact with the lower side of the cap.

6 Claims, 7 Drawing Figures

HANDLE ATTACHMENT FOR A BABY BOTTLE

BACKGROUND OF THE INVENTION

The field of this invention relates to handles for bottles and more particularly to a handle for a new and novel handle design for a baby bottle to facilitate the use of the baby bottle by the infant.

The normal type of baby bottle is basically cylindrical in construction and includes a cap through which a rubber nipple has been passed. The basically cylindrical shape of the baby bottle has been found to be difficult to grasp by a newborn infant. The bottle may frequently slide from the infant's hands as the infant's hands are just not large enough to extend around the bottle and establish a firm grip. The result is that the infant keeps dropping the bottle and normally cannot readily find the bottle himself which then requires that an adult pick up the bottle and replace the bottle in position for the infant.

It would be desirable to design some form of a handle means which would greatly facilitate the holding of the baby bottle by the infant.

SUMMARY OF THE INVENTION

The subject matter of this invention is believed to be summarily described within The Abstract Of The Disclosure and reference is to be had thereto.

The primary objective of the subject matter of this invention is to design a handle to be employed in conjunction with a baby bottle which facilitates holding of the baby bottle in the drinking position solely by the infant. The handle of this invention is designed to not include any sharp corners so as to be absolutely safe for use by the infant absolutely detering the possibility that there would be any sharp corner which would penetrate the infant's eyes or do anything to injure the infant. Another feature of the handle of this invention is that it can save time for the mother of the infant by permitting the infant to feed himself at an earlier age. A further advantage of this invention is that the handle assists in the education of the infant in order to teach the infant to raise the baby bottle in order to extract the drinking liquid therefrom.

DETAILED DESCRIPTION OF THE SHOWN EMBODIMENTS

Figure 1:
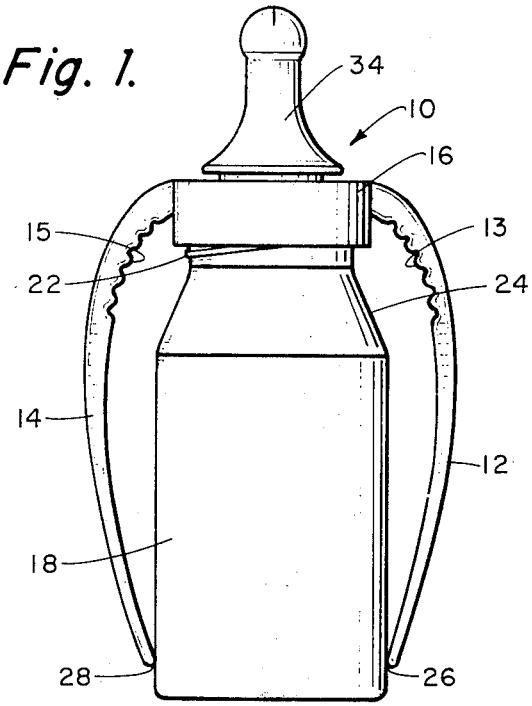
FIG. 1 is a front view of a first embodiment of the handle attachment of this invention showing such mounted in conjunction with a baby bottle.

Referring particularly to the drawing, there is shown in FIG. 1 the first embodiment 10 of handle attachment of this invention which includes a first handle 12, a second handle 14 and a baby bottle cap 16. The entire attachment 10 is to be constructed in an integral manner of a rigid non-toxic material such as a plastic. The handles 12 and 14 are located diametrically opposite each other with respect to the baby bottle 18. The baby bottle 18 is deemed to be of conventional construction and basically cylindrical in shape and having an upper open end 20. Surrounding the open end 20 are a plurality of threads 22. Adjacent the threads 22 is an inclined annular section 24. The normal construction of the baby bottle 18 will be of a plastic material. However, at times glass is frequently used.

The shape of each handle 12 and 14 is basically arcuate and the end 26 of handle 12 and the end 28 of handle 14 is positioned directly against the outside surface of the bottle 18. In actual practice, it may be desirable to design the handles 12 and 14 to be resilient so that they actually deflect when installed on the bottle 18 so as to insure that the ends 26 and 28 will be in tight contact with the bottle 18 at all times. There is a possibility that if the ends 26 and 28 are spaced from the bottle 18, that such may be caused to enter into the one of the infant's eyes and thereby cause injury to the infant.

Within the first embodiment 10 of this invention, each handle 12 and 14 includes a series of recesses in the area underneath each side of the handle, preferably in the area adjacent the cap 16. This serrated type of surface is to facilitate grasping and holding of the handle attachment 10 by the infant.

It is to be noted that within the first embodiment of this invention that the handles 12 and 14 are integrally secured to the cap 16. The cap 16 is basically conventional having a threaded interior 30 which engages with the threads 22. A nipple retaining opening 32 is formed within the cap 16 through which is to be placed the rubber nipple 34.

In the operation of the first embodiment of this invention it only requires that the nipple be inserted through the opening 32 of the cap 16 and the cap subsequently tightened upon the threads 32 of the bottle 18. The handle attachment of the first embodiment of this invention is then ready to be used.

Figure 5:
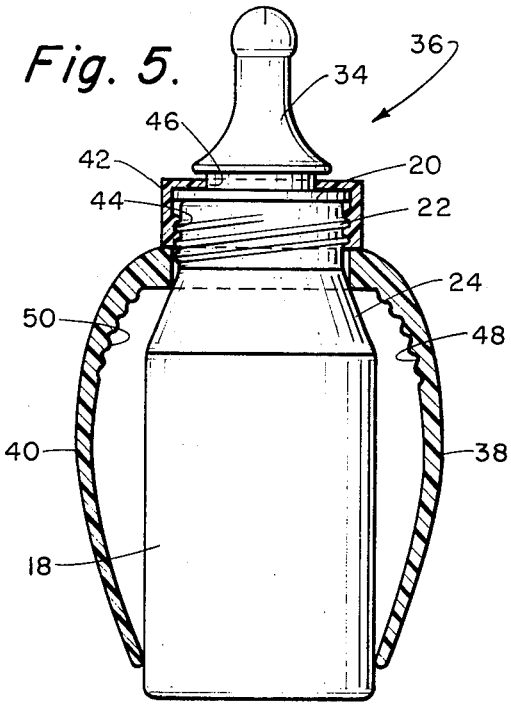
FIG. 5 is a cross-sectional view similar to FIG. 3 but of a second embodiment of handle attachment of this invention.
Figure 2:
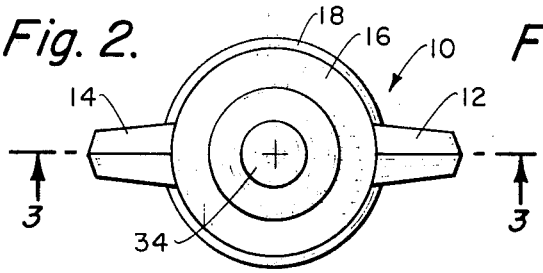
FIG. 2 is a top view of the handle attachment of FIG. 1.
Figure 4:
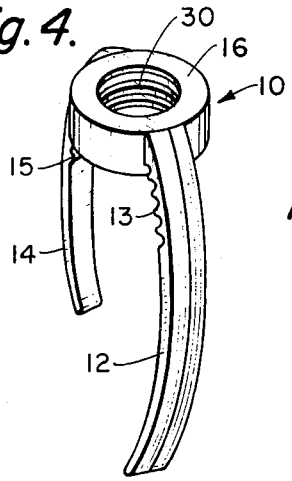
FIG. 4 is an isometric view of the first embodiment of the handle attachment of this invention.
Figure 6:
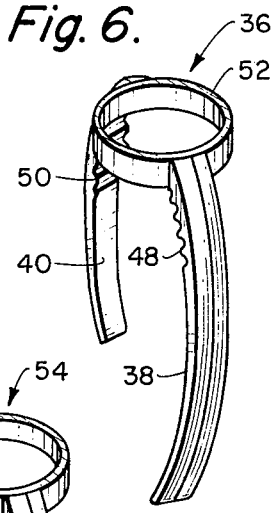
FIG. 6 is an isometric view of the second embodiment of handle attachment of this invention.
Figure 3:
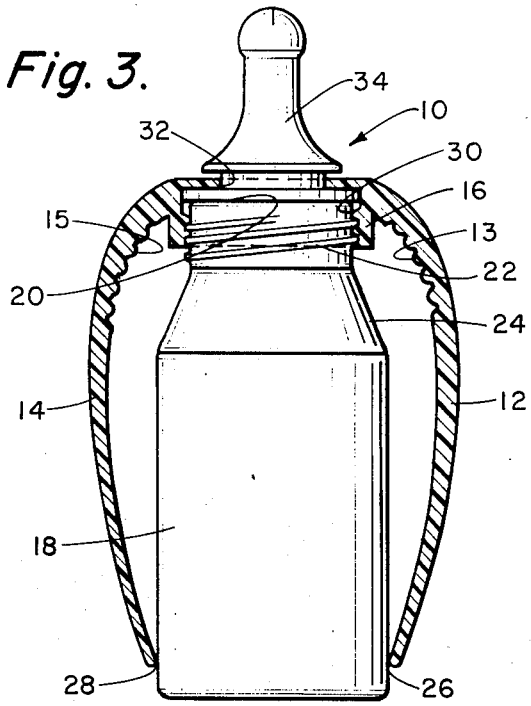
FIG. 3 is a cross-sectional view of the first embodiment of handle attachment of this invention taken along line 3—3 of FIG. 2.

Referring in particular to FIGS. 5 and 6 of the drawing, there is shown a second embodiment 36 of this invention which is to be mounted upon a baby bottle with like numerals referring to like parts.

The second embodiment 36 differs from the first embodiment in that the handles 38 and 40 are not attached to the cap 42. The cap 42 is deemed to be a conventional cap and includes interior threads 44 and a nipple access opening 46. The nipple 34 extends through the nipple access opening 46.

The handles 38 and 40 include serrated surfaces 48 and 50, respectively, similar to what was previously described in the first embodiment of this invention. Both the handles 38 and 40 are integrally secured to a ring 52. The ring 52 is to be located about the baby bottle 18 and in contact with the inclined surface 24. When the cap 42 of the baby bottle is tightened on the bottle, a wedging or tightening motion is achieved by binding of the ring 52 between the cap 42 and the inclined surface 24. This fixedly establishes, during use, the position of the second embodiment of this invention.

Figure 7:
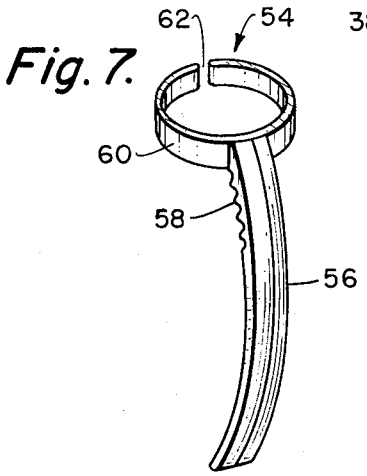
FIG. 7 is an isometric view of the third embodiment of handle attachment of this invention.

Referring particularly to FIG. 7 of drawings, a third embodiment 54 of this invention is shown. The third embodiment is shown as including the use of only a single handle 56 instead of the double handles previously shown. The free end of the single handle 56 is adapted to come into contact with the side wall of the baby bottle (not shown). The handle 56 includes on its interior surface thereof serrations 58. The handle 56 is integrally attached to a ring 60 which has a split 62 diametrically opposite the connection of the handle 56 to the ring 60. The function of the split 62 is to facilitate a slight expanding of the ring 60 when it is inserted over the threaded area of the baby bottle prior to coming into contact with the inclined surface 24.

It is considered to be within the scope of this invention that only a single handle could be integrally attached to the cap as shown within the first embodiment 10 of this invention.

It is also considered to be within the scope of this invention to integrally form the handles upon the bottle. The handles would attach to the bottle in the neck area and extend in an arcuate manner and terminate adjacent to the base of the bottle.

What is claimed is:

1. In combination with a baby bottle, said baby bottle having a cap, said cap being removably secured to said bottle, a rubber nipple extending exteriorly of said cap, the improvement comprising:

a handle extending from said cap, said handle including at least one arcuate handle, said arcuate handle having a free end, said free end being in continuous contact with the side wall of said baby bottle.

2. The combination as defined in Claim 1 wherein:

said handle is resiliently deflectable so that said free end of said handle is deflectable outwardly away from the side wall of said baby bottle in order to adapt the use of said handle to different sizes of baby bottles.

3. The combination as defined in Claim 2 wherein:

the interior surface of said handle includes serrations in order to facilitate grasping and holding of said handle by the infant.

4. The combination as defined in claim 3 wherein:

said handle is attached to a split ring, said split ring extending about the neck of said baby bottle in contact with the under surface of said cap.

5. The combination as defined in Claim 3 wherein:

there are two of said handles each being integrally connected to a solid annular ring, each of said handles being diametrically opposite each other with respect to said ring, whereby said ring extends about the neck of said baby bottle and beneath said cap.

6. The combination as defined in claim 3 wherein:

there are two of said handles, said handles are integrally connected to said cap, said handles being diametrically opposite each other with respect to said cap.

* * * * *